United States Patent [19]

Walker et al.

[11] Patent Number: 4,784,325

[45] Date of Patent: Nov. 15, 1988

[54] ROTATING STREAM SPRINKLER

[75] Inventors: Samuel C. Walker, Upland, Calif.; George H. Lockwood, Wilton Manors, Fla.; Kenneth V. McCarthy, Glendora; Raymond P. Feith, Covina, both of Calif.

[73] Assignee: Rain Bird Consumer Products Mfg. Corp., Glendora, Calif.

[21] Appl. No.: 33,990

[22] Filed: Apr. 1, 1987

[51] Int. Cl.[4] ..... B05B 3/04

[52] U.S. Cl. ..... 239/204; 239/230; 239/241; 239/DIG. 1; 239/577; 137/627; 251/262

[58] Field of Search ..... 239/447, 449, 240–242, 239/249, 204, DIG. 1, 205, 259, 264, 230, 537, 563, 579, 538, 572; 137/627, 256; 251/251, 262, 252

[56] References Cited

U.S. PATENT DOCUMENTS

| | | | |
|---|---|---|---|
| 1,191,247 | 7/1933 | Munz . | |
| 1,921,020 | 8/1933 | Birrell . | |
| 1,983,929 | 12/1934 | Buelna . | |
| 2,187,549 | 1/1940 | Thompson . | |
| 2,824,765 | 2/1958 | Stangle et al. | 239/DIG. 1 |
| 2,909,325 | 10/1959 | Hunter | 239/DIG. 1 |
| 2,985,380 | 5/1961 | Rosenkranz . | |
| 3,117,724 | 1/1964 | Ray . | |
| 3,263,930 | 8/1966 | Friedmann et al. . | |
| 3,272,437 | 9/1966 | Coson | 239/206 |
| 3,526,363 | 9/1970 | Hauser . | |
| 3,543,796 | 4/1970 | Duzant | 251/262 X |
| 3,583,638 | 6/1971 | Eby et al. | 239/206 |
| 3,602,431 | 8/1971 | Lockwood | 239/99 |
| 3,627,205 | 12/1971 | Healy | 239/206 |
| 3,645,451 | 2/1972 | Hauser | 239/206 |
| 3,702,676 | 11/1972 | Hauser . | |
| 3,713,584 | 1/1973 | Hunter | 239/206 |
| 3,771,723 | 11/1973 | Ray | 239/230 X |
| 3,785,565 | 1/1974 | Perry et al. | 239/200 |
| 3,854,664 | 12/1974 | Hunter | 239/206 |
| 3,874,588 | 4/1975 | Flynn | 239/230 X |
| 3,888,417 | 6/1975 | Harmon | 239/97 |
| 3,930,618 | 1/1976 | Lockwood | 239/230 |
| 3,934,820 | 1/1976 | Phaup | 239/205 |
| 3,952,953 | 4/1976 | Eby | 239/230 |
| 4,026,471 | 5/1977 | Hunter | 239/200 |
| 4,182,494 | 1/1980 | Wichman et al. | 239/230 |
| 4,253,608 | 3/1981 | Hunter | 239/206 |
| 4,417,691 | 11/1983 | Lockwood | 239/206 |
| 4,568,024 | 2/1986 | Hunter | 239/242 |
| 4,625,914 | 12/1986 | Sexton et al. | 239/206 |

*Primary Examiner*—Andres Kashnikow
*Assistant Examiner*—Kevin Patrick Weldon
*Attorney, Agent, or Firm*—Kelly, Bauersfeld & Lowry

[57] ABSTRACT

A rotating stream sprinkler is provided with an improved spray head for sweeping one or more outwardly projected water streams through a prescribed arcuate spray path, wherein the spray head is adapted for enhanced self-flushing operation to prevent accumulation of grit and the like which could otherwise impair sprinkler performance. In the preferred form, the spray head is mounted at the upper end of a pop-up stem for movement to an elevated spraying position upon supply of water under pressure to the sprinkler. The water flows to the spray head and normally pressure-loads a plurality of valve balls onto a respective plurality of seats to prevent water flow through the seats to associated nozzle passages. A drive assembly rotates the spray head relative to a nonrotating cam positioned to lift one or more of the valve balls from their respective seats to permit outward discharge of one or more water streams through the nozzle passages, within the limits of the prescribed arcuate path. In a preferred construction, the drive assembly includes a rotatable turbine driven by water inflow to the sprinkler and further includes drive balls for rotating the spray head in a stepwise manner. The turbine is also designed for improved operational reliability particularly when used with water having a significant amount of grit particles therein.

77 Claims, 8 Drawing Sheets

FIG. 4
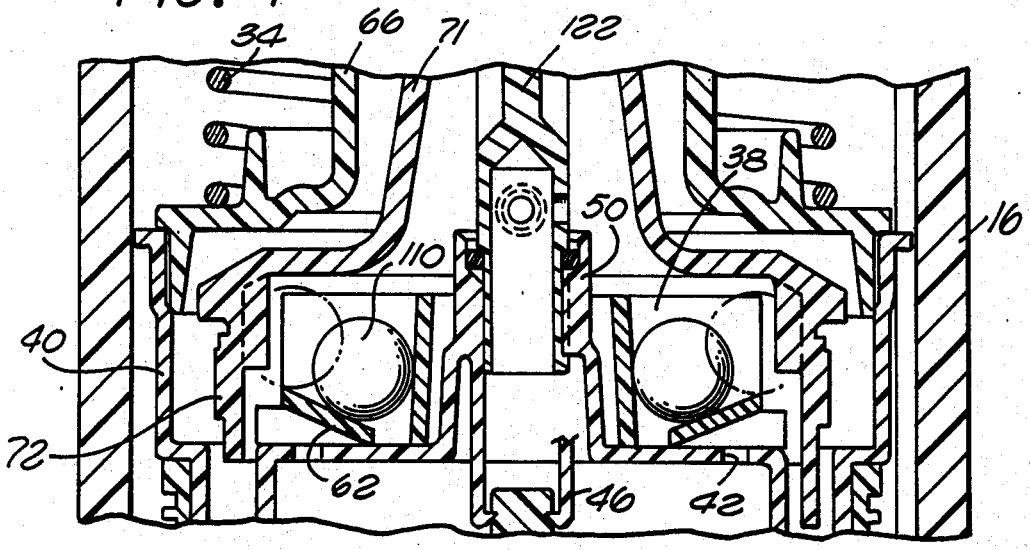
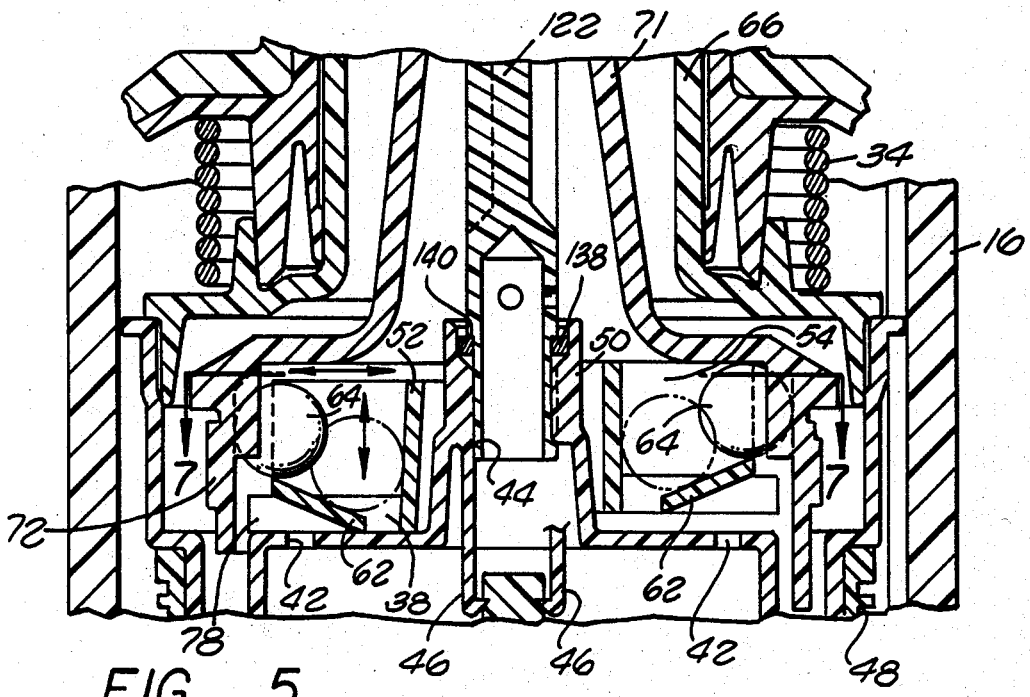
FIG. 5
FIG. 6
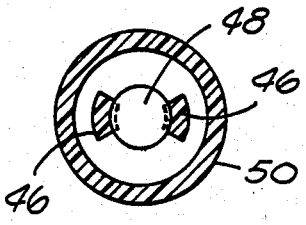

FIG. 7
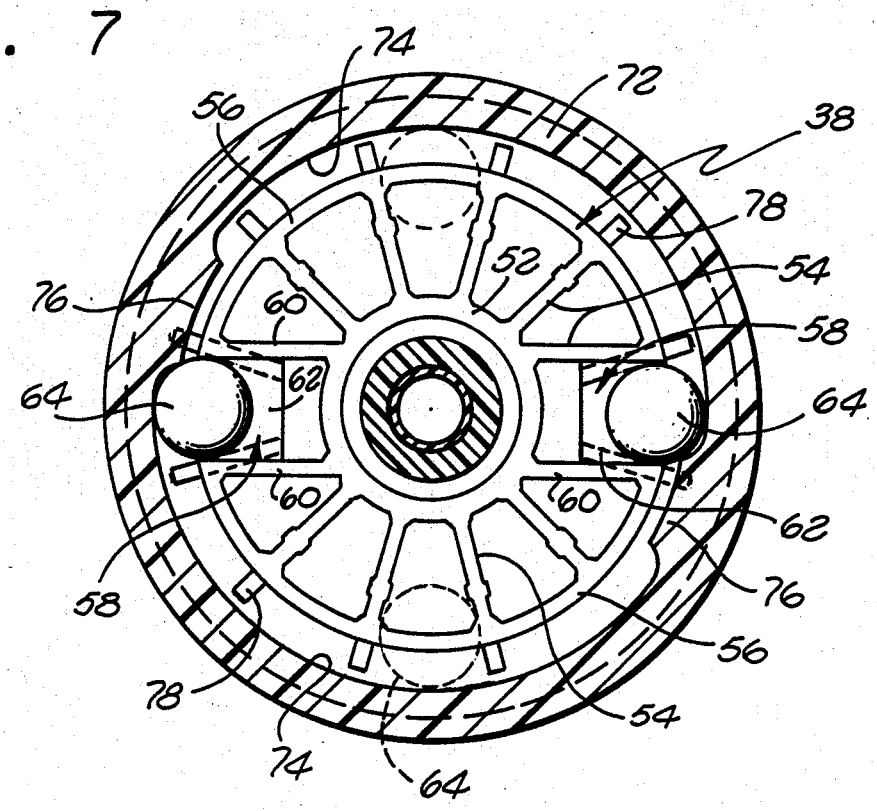
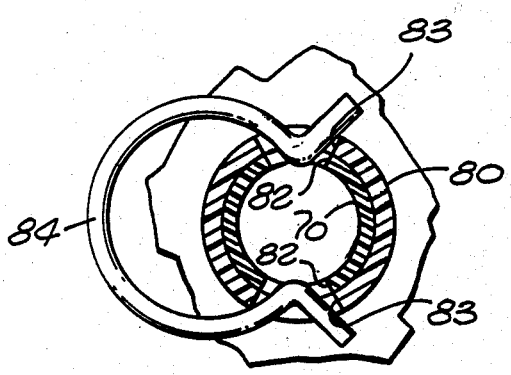
FIG. 8
FIG. 9
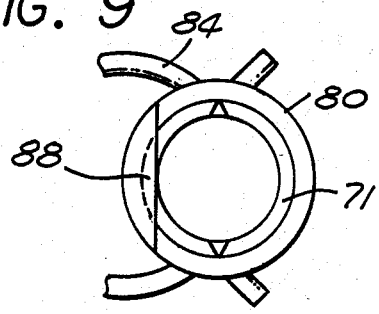
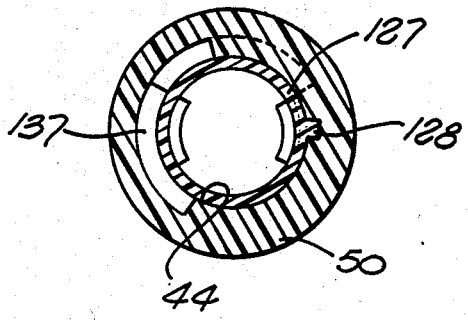
FIG. 13

FIG. 10
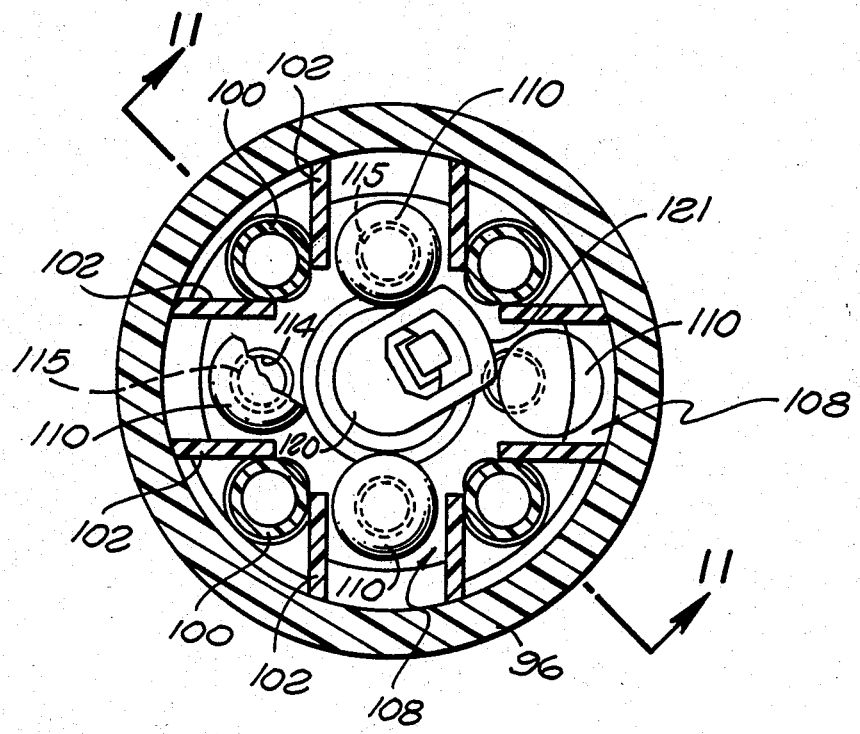
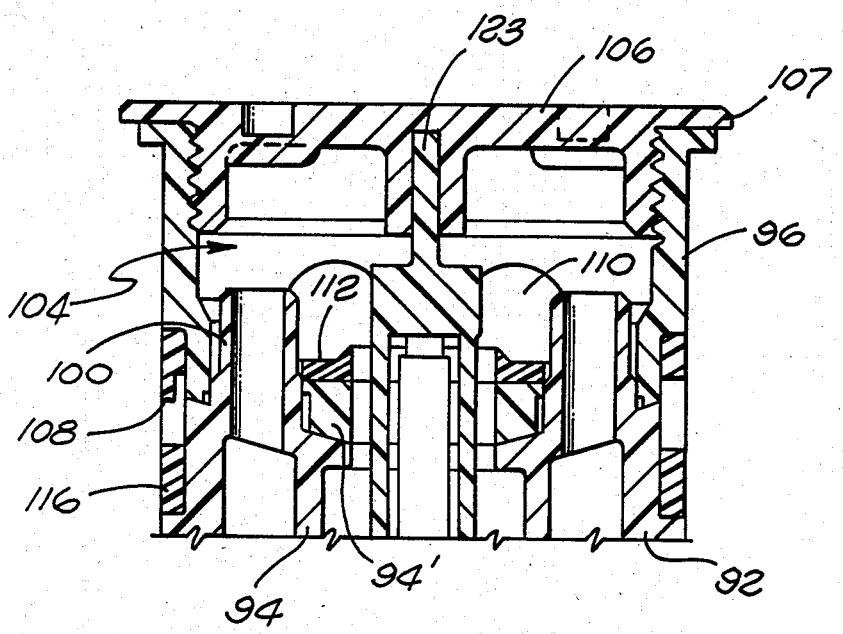
FIG. 11

FIG. 14
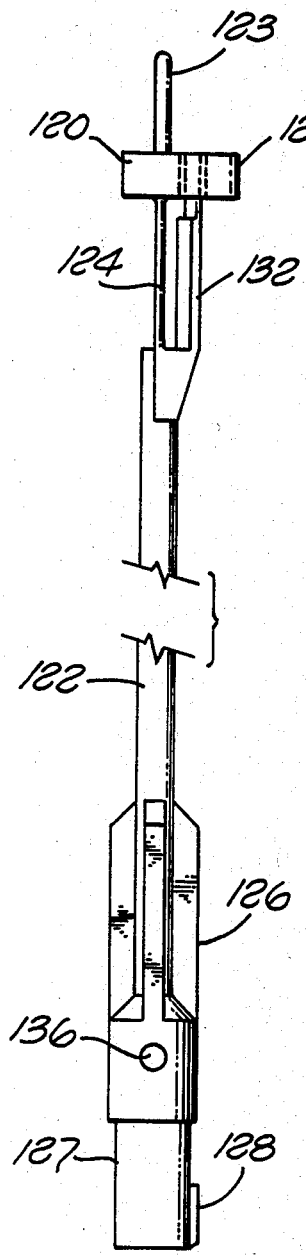
FIG. 18
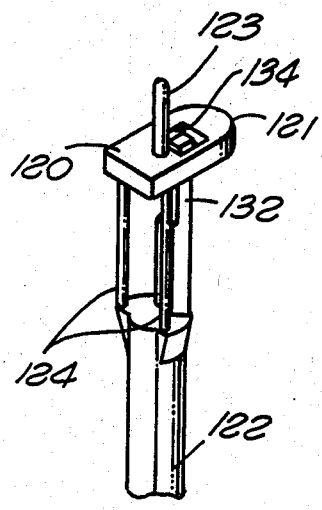
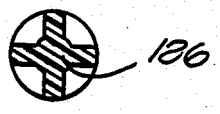
FIG. 17
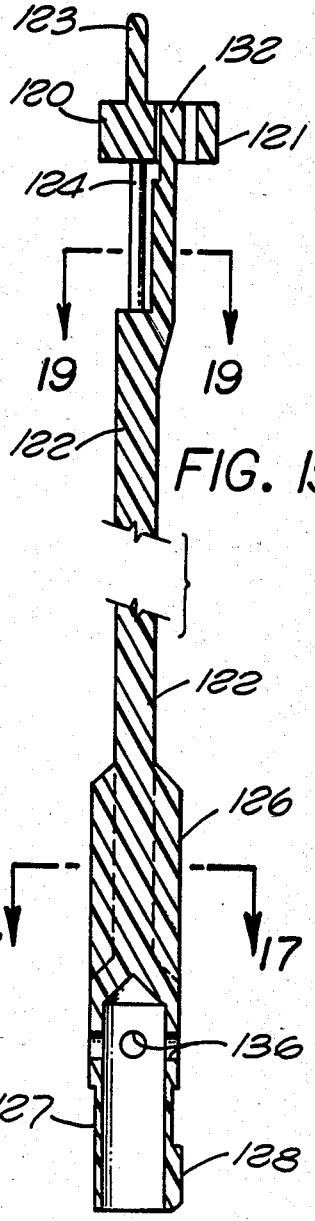
FIG. 15
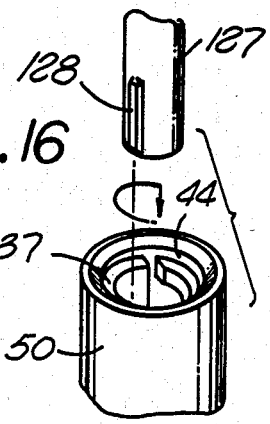
FIG. 16
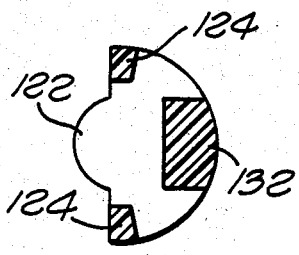
FIG. 19

ROTATING STREAM SPRINKLER

BACKGROUND OF THE INVENTION

This invention relates generally to irrigation water sprinklers of the type having a sprinkler spray head or nozzle for rotating one or more outwardly projected water streams through a prescribed arcuate spray path. More particularly, this invention relates to an improved irrigation sprinkler having an improved spray head and improved rotary drive means designed for self-flushing operation to prevent accumulation of water-entrained grit and other particles which could otherwise impair performance reliability and consistency.

Irrigation sprinklers are well known of the general type designed to provide one or more outwardly projected streams of irrigation water. Such irrigation sprinklers traditionally include a sprinkler body having one or more spray nozzles mounted thereon, wherein the sprinkler body is rotatable for sweeping the discharged water stream or streams through a prescribed arcuate spray path, such as a quarter-circle, half-circle or full-circle path, to irrigate surrounding vegetation. In this regard, the sprinkler further includes a rotary drive mechanism, for example, an impact or reaction drive mechanism which is water-driven to rotate the sprinkler body over the prescribed spray path. Other types of rotary drive mechanisms include water-driven turbines and drive balls for rotating at least the portion of the sprinkler body carrying the spray nozzle resulting in water distribution over the desired terrain area.

In some specialized irrigation applications, it is desirable to deliver irrigation water to surrounding terrain at a relatively low precipitation rate primarily to avoid excess water run-off and waste. In addition, it is sometimes desirable to provide such low precipitation rates by use of a relatively small number of irrigation sprinkler devices to correspondingly minimize system cost and complexity including, for example, the required number of sprinkler heads and related piping and controls. To this end, rotating stream sprinklers have been developed to provide one or more discrete water streams which are projected outwardly with substantial range but at a relatively low flow rate. Such sprinklers have normally included internal drive mechanisms for rotating the water streams continuously or in a succession of small rotational steps at a relatively slow angular velocity to sweep the projected water stream or streams through the prescribed part-circle or full-circle spray path. In rotating stream sprinklers of this type, the drive mechanisms traditionally have comprised turbine drive, ball drive, and/or gear drive components which, unfortunately, have been designed and assembled in a manner rendering the drive mechanism unduly susceptible to jamming upon accumulation of small grit and other particles in and about the moving components. As a result, such rotating stream sprinklers have experienced inconsistent and/or unreliable operating performance due to the presence of significant quantities of grit in most water supply systems. Accordingly, to insure reliable operation of the sprinkler, it has been necessary to provide significant water filtering capability, resulting in undesirable increases in irrigation system cost and complexity.

There exists, therefore, a significant need for an improved irrigation sprinkler of the type providing one or more outwardly projected discrete water streams swept through an arcuate spray path of predetermined size, wherein the improved sprinkler is designed for effective self-flushing operation of internal drive and nozzle components to prevent grit accumulation and accompanying performance impairment. The present invention fulfills these needs and provides further related advantages.

SUMMARY OF THE INVENTION

In accordance with the invention, an improved rotating stream sprinkler includes a spray head for providing one or more discrete water streams projected outwardly from the sprinkler, and related drive means for rotating the spray head in a manner sweeping the discrete water streams through a prescribed arcuate spray path. Both the spray head and the drive means are designed for substantially improved performance while operating with water having entrained grit or the like.

In accordance with a preferred form of the invention, the drive means is mounted within a sprinkler housing and includes rotary drive means engaged with the lower end of a drive sleeve. The drive sleeve is rotatably mounted within a bearing sleeve, and a spray head is mounted at the upper end of the drive sleeve. The drive sleeve, bearing sleeve and spray head constitute a pop-up assembly adapted for movement between a normal retracted position within the sprinkler housing and an elevated spraying position upon supply of water under pressure to the sprinkler housing. Water flowing into the housing is guided upwardly into a flow chamber within the spray head and acts to pressure-load a plurality of valve members such as valve balls into seated engagement with a respective plurality of valve seats to close associated valve ports. The valve members and valve ports are rotated with the drive sleeve and the spray head to carry the valve members into contact with a nonrotating cam which lifts the valve members from their seats thereby opening the valve ports to permit water flow into nozzle passages from which the water is projected outwardly from the sprinkler. Such water flow advantageously flushes any grit from the valve seats. Importantly, the cam is sized to maintain the valve member or members lifted off said seats during rotation of the associated nozzle passage or passages through the prescribed arcuate spray path, for example, a part-circle spray path. In addition, the cam is optimally designed to lift and subsequently to reseat each valve member with a rapid snaplike action to provide rapid and substantially complete opening and closing of the related valve ports.

The preferred rotary drive means comprises a water-driven turbine carried within a drive case which is attached to the lower end of the bearing sleeve. Swirl ports in the drive case admit water flow into the drive case interior with a swirling action for rotationally driving the turbine in a selected rotational direction. In this regard, the drive turbine is relatively loosely supported for rotation within the drive case, with substantial clearance between all surfaces of the turbine and surrounding members to prevent entrapment of water-entrained grit and the like which could otherwise impair turbine rotation.

The water turbine includes at least two drive balls supported symmetrically relative to an axis of rotation for the turbine, wherein these drive balls are individually supported upon ramped floors set angularly to insure drive ball displacement in a radially inward direction to a nondriving position nearer to the turbine rotational axis when turbine rotation is stopped or relatively slow, for example, during start-up conditions. However, turbine rotation at or above a threshold speed carries the drive balls by centrifugal action in radially outward directions into contact with a generally cylindrical ball race formed within an enlarged lower end of the drive sleeve. This ball race is interrupted by a symmetrically arranged plurality of radially inset anvils, preferrably corresponding in number with the number of drive balls, resulting in a regular succession of impacts of the drive balls with the anvils to rotate the drive sleeve through a repeating succession of small rotational steps. Such drive sleeve rotation carries the spray head through the same rotational steps to displace the valve members therein into and then out of contact with the lift-off cam, as previously described.

In accordance with further aspects of the invention, the rotary drive means includes bypass means for bypassing a portion of the water flow through the sprinkler away from driving relation with the water turbine. The bypassed water flows through an open bypass port in the drive case, wherein the bypass port is sized in relation to the open flow area provided by the number of open valve seats within the spray head at any time. In this manner, the bypass flow is adjusted each time the size of the lift-off cam is adjusted to change the width of the arcuate spray path to be irrigated, thus insuring the same flow of water into association with the water turbine irrespective of the spray path width, and a resultant consistency of rotational driving.

The lift-off cam is designed for convenient access from above the sprinkler housing upon removal of an exposed spray head cap. The lift-off cam can then be removed from the sprinkler and replaced by an alternative cam of different arcuate width to alter the width of the spray path to be irrigated. In the preferred form, the cam is formed at the upper end of an elongated cam rod having a base end adapted for self-guiding reception into a central bore in the drive case. The base end of the cam rod includes one or more bypass ports of appropriate total area for bypass water flow around the turbine. Alternately, the cam and the cam rod, along with the valve members in the spray head, may be omitted to provide a full-circle spray pattern, in which event the bypass flow in controlled by the size of the central bore in the drive case.

In accordance with still further features of the invention, the pop-up assembly includes a bearing seal means for accommodating smooth rotation while preventing grit intrusion between the relatively rotating components. This bearing seal means incorporates a seal ring positioned between the bearing sleeve and the spray head and biased by a spring to close any gaps therebetween during transition movement of the pop-up assembly between the retracted and elevated positions. However, when the pop-up assembly is in the elevated position for operation, water pressure within the bearing sleeve overcomes the biasing spring to create a gap between the components at the seal ring for permitting component rotation with reduced friction.

Other features and advantages of the present invention will become more apparent from the following detailed description, taken in conjunction with the accompanying drawings, which illustrate, by way of example, the principles of the invention.

BRIEF DESCRIPTION OF THE DRAWINGS

The accompanying drawings illustrate the invention. In such drawings:

FIG. 4 is a fragmented and further enlarged vertical sectional view of the sprinkler, corresponding with a portion of FIG. 3, and illustrating the construction of improved rotary drive means for the sprinkler;

FIG. 5 is a fragmented vertical sectional view similar to FIG. 4 but illustrating the sprinkler in the elevated spraying position and depicting operation of the rotary drive means;

FIG. 6 is an enlarged horizontal sectional view taken generally on the line 6—6 of FIG. 3;

FIG. 7 is a horizontal sectional view taken generally on the line 7—7 of FIG. 5.

FIG. 8 is a fragmented enlarged horizontal sectional view taken generally of the line 8—8 of FIG. 3;

FIG. 9 is a fragmented enlarged horizontal sectional view taken generally of the line 9—9 of FIG. 3;

FIG. 10 is an enlarged fragmented horizontal sectional view taken generally on the line 10—10 of FIG. 3;

FIG. 11 is a fragmented vertical sectional view taken generally on the line 11—11 of FIG. 10;

FIG. 13 is an enlarged fragmented horizontal sectional view taken generally on the line 13—13 of FIG. 3;

FIG. 14 is an enlarged fragmented elevation view depicting a cam and related cam rod for use in the rotating streamsprinkler of the invention;

FIG. 15 is a fragmented vertical sectional view illustrating further construction details of the cam and cam rod of FIG. 14;

FIG. 16 is a fragmented exploded perspective view illustrating self-guiding installation of the cam rod;

FIG. 17 is a horizontal sectional view taken generally of the line 17—17 of FIG. 15;

FIG. 18 is a fragmented perspective view depicting further construction details of the preferred cam and cam rod;

FIG. 19 is an enlarged horizontal sectional view taken generally on the line 19—19 of FIG. 15;

DETAILED DESCRIPTION OF THE PREFERRED EMBODIMENT

Figure 1:
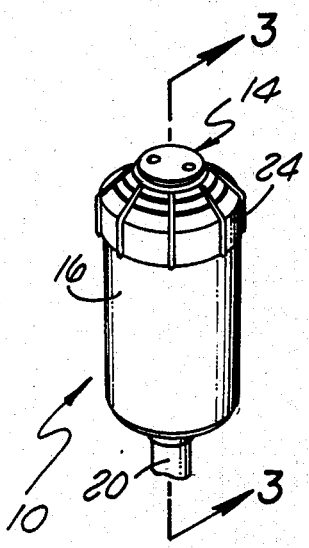
FIG. 1 is a perspective view illustrating a rotating stream pop-up sprinkler embodying the novel features of the invention and showing a spray head in a retracted position substantially concealed within a sprinkler housing.
Figure 2:
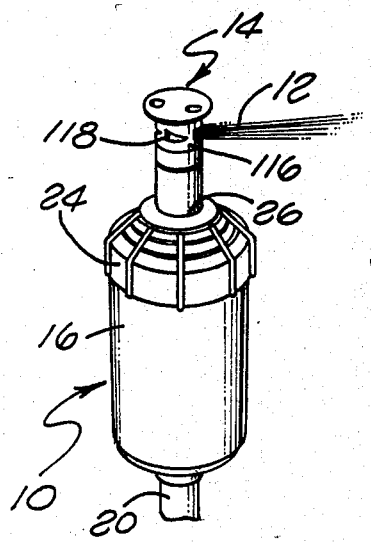
FIG. 2 is a perspective view similar to FIG. 1 but depicting the spray head in an elevated spraying position.

As shown in the exemplary drawings, a rotary drive sprinkler referred to generally in FIGS. 1 and 2 by the reference numeral 10 is provided for delivering one or more streams 12 of irrigation water to surrounding vegetation (not shown) for irrigation purposes. The sprinkler 10, in accordance with the preferred form of the invention, includes a pop-up spray head 14 designed for outward projection of the stream or streams 12 in the form of relatively narrow discrete water streams. Drive means within the sprinkler 10 rotatably drives the spray head 14 in a manner distributing the streams over an arcuate spray path of predetermined width. Both the spray head 14 and the internal drive means are designed for self-flushing operation to avoid entrapment or accumulation of water-carried grit or other particulate, wherein collection of such particulate within the sprinkler could otherwise lead to inconsistent and/or unreliable operation.

More particularly, the improved rotary drive sprinkler 10 of the present invention incorporates internal drive components and flow passages designed to provide an open and unrestricted self-flushing action during sprinkler operation. As a result, the traditional grit and the like commonly encountered in most unfiltered water supplies will wash through the sprinkler substantially without accumulation in areas interfering with moving components of the sprinkler. Importantly, moving drive components of the sprinkler drive means are provided with substantially unrestricted flow passages around and about all surfaces thereof to prevent grit-induced performance degradation. In addition, the spray head 14 includes relatively open, self-flushing passages to prevent grit entrapment which could otherwise interfere with spray head operation and/or clog nozzle passages.

Figure 3:
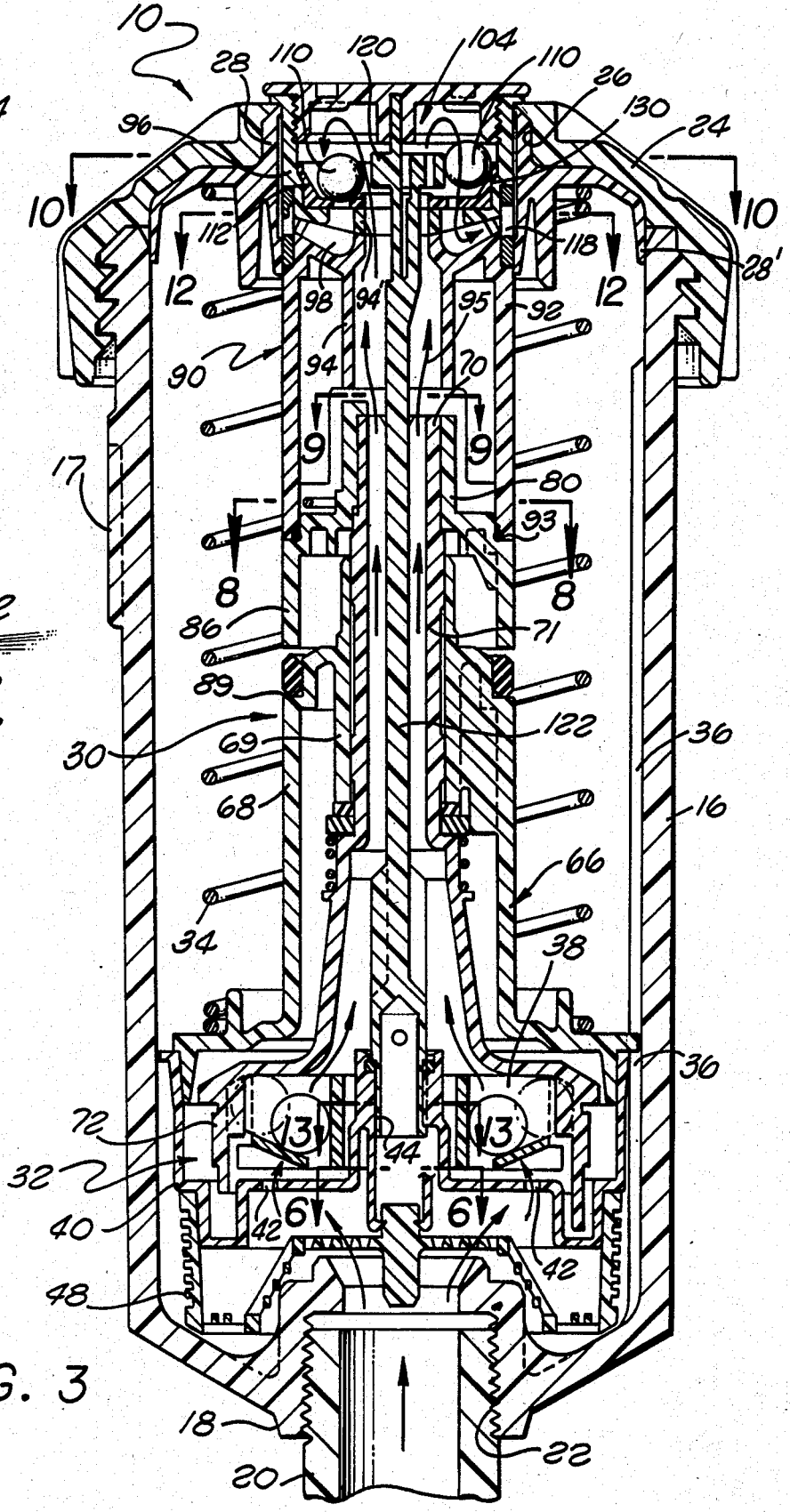
FIG. 3 is an enlarged vertical sectional view of the pop-up sprinkler taken generally on the line 3—3 of FIG. 1.
Figure 12:
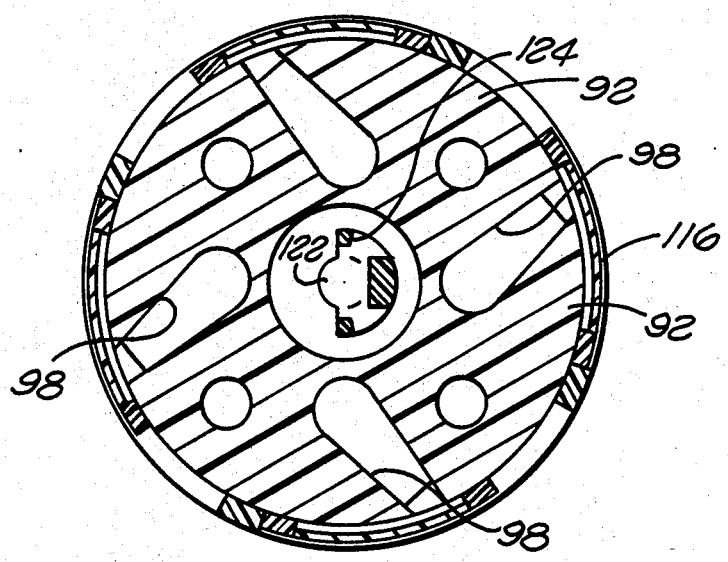
FIG. 12 is an enlarged fragmented horizontal sectional view taken generally on the line 12—12 of FIG. 3.

As shown generally in FIGS. 1 and 2, and more specifically in FIG. 3, the illustrative pop-up sprinkler includes a sprinkler housing 16 with a relatively conventional, upright cylindrical shape formed typically from a lightweight molded plastic or the like. An inlet fitting 18 is formed at the lower end of the housing and is adapted for connection to the end of a water supply pipe 20 through which irrigation water under pressure is supplied normally under the control of a remote control valve (not shown). The water flows into the housing interior through an inlet opening 22 (FIG. 3), with the upper end of the housing 16 being typically threaded or the like for removable connection of a housing cap 24. The cap 24 has a central opening 26 therein through which the spray head 14 moves between retracted and elevated positions. An annular wiper seal member 28 of flexible molded seal material or the like is seated within the cap central opening 26 and conveniently includes an outer flange 28' overlapping the juncture between the housing 16 and the cap 24 to prevent water leakage therebetween, without requiring the use of any other seal device.

The spray head 14 is mounted at the upper end and comprises a portion of a pop-up assembly 30, as shown in FIGS. 2 and 3. The pop-up assembly 30 is attached in turn at its lower end to the drive means in the form of a rotary drive assembly 32, with the pop-up assembly and the drive assembly being movable together between the retracted position (FIGS. 1 and 3) and the elevated spraying position (FIG. 2) wherein the spray head 14 is spaced above the sprinkler housing 16 and operated to distribute the stream or streams 12 over the prescribed spray path. A retraction spring 34 such as a helical compression spring is coiled about the pop-up assembly 30 and reacts between the underside of the housing cap 24 and an upwardly presented surface on the drive assembly 32 to urge the entire pop-up assembly normally toward the retracted position. A key 36 on the inner side of the housing 16 is received into a vertical slot 37 on the drive assembly 32 to guide the pop-up assembly between the retracted and elevated positions, while securing the various components against rotation within the housing, as will be described in more detail.

When irrigation water under pressure is supplied to the sprinkler housing 16 via the lower inlet fitting 18, the pressure of the water overcomes the downward force of the retraction spring causing the entire pop-up assembly and drive assembly to be displaced upwardly to the elevated spraying position. In this position, a portion of the water supplied to the sprinkler is directed into driving relation with a water turbine 38 which functions to rotatably drive the spray head 14 about a vertical axis to correspondingly sweep the outwardly projected stream or streams 12 through the prescribed arcuate spray path. Any remaining portion of the water inflow bypasses the turbine 38 and flows directly to the spray head 14 for outward projection from the sprinkler.

As shown best in FIGS. 2–7, the rotary drive assembly 32 comprises, in the preferred form, a balanced ball drive assembly having the turbine 38 designed particularly to avoid accumulations of grit and the like which could interfere with reliable performance. More specifically, the drive assembly 32 comprises a generally cup-shaped drive case 40 defining at least two open swirl ports 42 which are appropriately angled to admit water in an upward direction with a substantial swirling flow action, for example, in a clockwise direction, into driving relation with the turbine 38. In addition, the drive case 40 includes an open central bore 44 for upward bypass passage of a portion of the water to a location hydraulically downstream from the turbine 38. A pair of gripper fingers 46 (FIGS. 3 and 6) descend from the drive case 40 in the vicinity of this bore 44 for snap-fit attachment to a lower cup-shaped filter screen 48 designed to prevent passage of unduly large debris such as pebbles, etc. into the drive assembly.

The central bore 44 in the drive case 40 is defined by a generally cylindrical hub 50 which loosely locates the turbine 38 for rotation. More particularly, the turbine 38 includes an inner cylinder 52 sized for relatively loose reception about the hub 50 to permit turbine rotation in a free floating manner without creating confined spaces or providing close tolerances within which grit can accumulate. The turbine 38 further includes a plurality of outwardly radiating vanes 54 joined at or near their outer ends by an outer cylindrical shroud 56 (FIG. 7). The vanes 54 and the shroud 56 cooperatively define broad surfaces for rotational driving by the swirling water flow, while also providing substantially unrestricted upward flow to insure upward flushing of grit and any other particulate.

The turbine 38 also defines a symmetrically arranged plurality of radially outwardly open ball tracks 58, with two of said tracks being shown in the illustrative drawings. As viewed best in FIG. 7, each track 58 is defined by a parallel pair of track side walls 60 projecting radially outwardly from the inner cylinder 52, together with a ramped floor 62. The ramped floor 62 for each track 58 has an inner end spaced from the inner cylinder 52 of the turbine to permit free flushing flow therebetween. From the inner end, the ramped floor 62 is inclined to extend upwardly to the radially outer end, terminating generally at or near the shroud 56.

The ball tracks 58 of the turbine 38 each support a drive ball 64 sized for relatively free radial rolling motion within the tracks. When the turbine 38 is at rest or rotated at a relatively slow speed, the drive balls 64 remain at radially inset positions (FIG. 4) resting against the inner cylinder 52 of the turbine. However, when the turbine 38 is rotated at a sufficient speed, the drive balls 64 are displaced radially outwardly along the ramped floors 62 to drive the spray head 14, as will be described. Accordingly, when turbine operation is halted, the drive balls 64 move down the ramps to the radially inset positions and remain there upon resumed turbine rotation until the turbine rotational speed reaches or exceeds a threshold speed. Importantly, the water flow into driving association with the turbine is sufficient to drive the turbine at this threshold speed when the spray head 14 is in the elevated spraying position.

The upper end of the drive case 40 is attached to a bearing sleeve 66 having a size and shape for snap-fit locking or the like onto the drive case. This bearing sleeve 66, as shown best in FIG. 3, includes a central upstanding guide cylinder 68 having an upper, elongated center guide 69 rotatably receiving the tubular upper end 70 of a drive sleeve 71. From the center guide 69, the drive sleeve 71 extends downwardly within the bearing sleeve 66 and with an expanding cross section terminating ultimately in a generally cylindrical lower drive ring 72. This drive ring 72 is positioned generally concentrically about the water turbine 38 and includes an inner diameter surface defining a ball race 74 for normal rolling engagement by the drive balls 64 when the turbine is rotated at or above the threshold speed. The ball race 74 is interrupted by a symmetrically disposed number of radially inset anvils 76 which are thus impacted by the drive balls to rotate the entire drive sleeve through a small rotational step. In the preferred form, the number of said anvils 76 corresponds with the number of drive balls 64 such that the balls 64 impact the anvils 76 substantially simultaneously for maximum rotational drive forces imparted to the drive sleeve. Upon such impact, the drive balls 64 are deflected radially inwardly to permit continued turbine rotation such that the drive balls impact the anvils in regular succession to rotate the drive sleeve 71 in a series of small rotational steps. Conveniently, lower tabs 78 on the turbine 38 project a short distance beyond the outer shroud 56 and are sized to contact the ball race 74 beneath the anvils 76 prior to shroud contact with the anvils, to correspondingly prevent turbine jamming with the anvils.

In accordance with one aspect of the invention, it has been found that the drive assembly 32 exhibits enhanced reliability, including but not limited to reduced tendency to entrap grit and reduced wear due to fatigue and abrasion, when one or more of the impacting drive components is made from a somewhat resilient material. In this regard, the anvils 76 on the drive ring 72 can be formed from a resilient material. In addition, the turbine 38 and the track side walls 60 in particular can be formed from a resilient material. Still further, if desired, the ball race 74 and the drive balls 64 can be formed or coated with a resilient material. For this purpose, the aforementioned operational improvements are particularly noted when the resilient material is softer than traditional acetal plastics and the like of the type commonly used for plastic molded components in products of this type. Alternately stated, resilient plastic molded materials having a hardness reading on the Rockwell scale of less than about R100, or a hardness of Shore durometer D80 or less will provide the requisite resiliency for improved operation. In addition, due to the softer impacting components, significantly quieter operation results.

The tubular upper end 70 of the drive sleeve 71 projects upwardly through the guide sleeve 69 of the bearing sleeve 66 for connection to the spray head 14 of the improved sprinkler. This connection is shown best in FIGS. 3, 8 and 9 which depict a spray head base 80 of generally cylindrical construction sized to fit about the upper end of the drive sleeve. Open side notches 82 in the spray head base 80 and aligned notches 83 in the drive sleeve 71 receive inwardly bent fingers of a C-shaped locking clip 84 or the like to secure the components together, with the base 80 and the drive sleeve having matched sets of flattened inner and outer surfaces, respectively, for proper alignment of the notches 82 and 83 and to provide a rotatable drive connection between the components. A diametrically enlarged skirt 86 projects downwardly from the spray head base 80 (FIG. 3) to enshroud a portion of the guide sleeve 69, and an upper lip 88 on the base engages the axially upper end of the drive sleeve.

A nozzle assembly 90 forms the balance of the spray head 14 and includes a lower, generally cylindrical nozzle portion 92 seated upon and secured in a suitable manner by a sonic weld 93 or the like to the spray head base 80. The lower nozzle portion projects upwardly from the base 80 to a contoured axially upper face merging in turn with an inner flow cylinder 94 for upward water passage from the hollow drive sleeve 71 into the spray head, as depicted in FIG. 3 by arrows 95. An upper nozzle portion 96 is attached suitably, for example, by sonic welding or the like, onto the lower nozzle portion and includes a contoured lower face cooperating with the contoured upper face of the lower nozzle portion to define a continuation 94' of the central flow cylinder surrounded by a plurality of nozzle passages 98 disposed in symmetric array about the inner flow cylinder. In the exemplary drawings, four of these nozzle passages 98 are provided to extend downwardly and then generally radially outwardly with an upward angle of inclination for outward projection of water streams from the sprinkler.

As shown in FIGS. 3 and 10–12, the lower nozzle portion 92 further includes a plurality of upstanding hollow mounting posts 100 projecting into the upper nozzle portion 96. These posts 100 thus cooperate with the central flow cylinder 94, 94' to insure substantially unimpeded water flow upwardly into a flow chamber 104 above the nozzle passages 98. A cap 106 closes the upper extent of this flow chamber 104, for example, by threaded reception into the upper end of the upper nozzle portion 96, wherein the cap 106 may be removable for convenient service or maintenance access to the spray head 14 or other sprinkler components as will be described in more detail. An outer rim 107 formed cooperatively on the cap 106 and the upper nozzle portion 96 normally rests upon the sprinkler housing cap 24 when the pop-up assembly 30 is in the normal retracted position, as viewed in FIG. 3.

As shown in FIG. 10, an annular valve seat ring 112 of resilient material is positioned within the flow chamber 104 and defines a plurality of open valve ports 114 with discrete resilient valve seats 115 at the upstream ends of the nozzle passages 98. This seat ring 112 further defines a plurality of upstanding guide walls 102 which form a plurality of radially open tracks 108 each having a valve member in the form of a valve ball 110 carried therein. These valve balls 110 are respectively positioned directly over the downwardly opening valve ports 114 and associated seats 115 (FIGS. 3 and 10) and have sufficient radial freedom of motion to open and close the underlying nozzle passages to water flow. The valve seats 115 are shaped for positive engagement by the respective valve balls to close the ports 114 against water flow.

In accordance with one aspect of the invention, the above-described spray head 14 is rotatably driven by the drive sleeve 71 in a stepwise manner during sprinkler operation. Accordingly, the nozzle passages 98 are rotated whereby water flowing through the nozzle passages when the valve balls 110 are moved to open the ports 114 is discharged outwardly as discrete water streams which are swept in a stepwise fashion to distribute irrigation water over surrounding terrain. Conveniently, as viewed in FIG. 12, the radially outwardly extending portions of the nozzle passages 98 are radially offset from a true radius of the spray head such that the discharged water streams impart reaction forces to the spray head in a direction assisting stepwise driving in response to operation of the drive assembly. In the illustrative embodiment, such stepwise driving occurs in a clockwise direction as viewed from the top of the sprinkler. In addition, a radius reducer ring 116 is conveniently seated within an outer groove in the spray head, defined cooperatively by the lower and upper nozzle portions 92 and 96, and includes angled and/or serrated openings 118 (FIGS. 2, 3 and 11) which can be rotated relative to the discharge ends of the nozzle passages 98 to control the projected radius of throw of the discharged water streams.

During sprinkler operation, the water flowing upwardly into the flow chamber 104 in the spray head 14 pressure-loads the valve balls 110 toward positions closing the underlying valve ports 114 to prevent outward discharge of the water from the sprinkler. The valve balls 110 are unseated from the seats 115 by a cam 120 in a manner closely controlling the number of nozzle passages 98 open to water flow at any given time, as well as the angular segment of sprinkler rotation through which one or more nozzle passages are opened to water flow. Accordingly, the cam 120 accurately controls the distribution of water streams over a prescribed arcuate spray path about the sprinkler, while closing the nozzle passages to prevent spraying of water onto terrain outside the chosen spray path.

More specifically, as shown in FIGS. 3 and 14–22, the cam 120 comprises in one preferred form a quarter-circle cam designed to unseat the valve balls 110 one at a time to permit distribution of a single water stream 12 over a quarter-circle spray path. This quarter-circle cam 120 comprises a generally rectangular cam block carried within the spray head flow chamber 104 near the upper end of a cam rod 122. This cam rod 122 includes an upper guide shaft 123 seated within an appropriate socket formed on the underside of the spray head cap 106, together with a pair of downwardly projecting torsion arms 124 offset from a rod central axis (FIG. 18) and interconnecting the cam block with a main cam rod. This main cam rod extends downwardly with flow clearances within the drive sleeve 71 to an enlarged guide base 126 of X-shaped or other ribbed cross-section. This guide base 126 merges in turn with a downwardly open, hollow lower end 127 of generally cylindrical shape sized to seat into the central bore 44 of the drive case hub 50. A key 128 on the lower end 127 of the cam rod is meshed with a vertical keyway in the bore 44 to lock the cam rod 122 against rotation with the drive sleeve 71 and the spray head 14.

As the spray head rotates during sprinkler operation, the valve balls 110 are displaced in a stepwise fashion in succession by engagement with a contoured nose 121 of the quarter-circle cam 120. Spray head rotation causes the valve ball 110 engaged by the cam to be displaced radially outwardly from the underlying valve port 114, and upwardly along a ramp 130 defined by the valve seat ring 112 (FIG. 3), thereby opening the port 114 and associated nozzle passage 98 to water flow. The valve ball 110 remains in the open position for ninety degrees of spray head rotation as determined by the width of the cam nose 121, after which the cam releases the valve ball 110 for movement back toward the closed position while simultaneously engaging and opening the next valve ball in sequence. Importantly, when each one of the valve balls 110 is in the open position, the water flow through the spray head 14 serves to flush grit and any other particulate material from the associated port 114 and valve seat 115 to prevent undesired clogging or impairment of sprinkler performance.

In accordance with a further primary aspect of the invention, the torsion arms 124 of the cam rod 122 control cam operation in a manner providing rapid valve ball movement to an open position, and a correspondingly rapid valve ball return to the closed position. This arrangement advantageously provides substantially full range water flow at the initiation and conclusion of the prescribed arcuate spray path, for better water coverage throughout the entire arcuate spray path.

Figure 22:
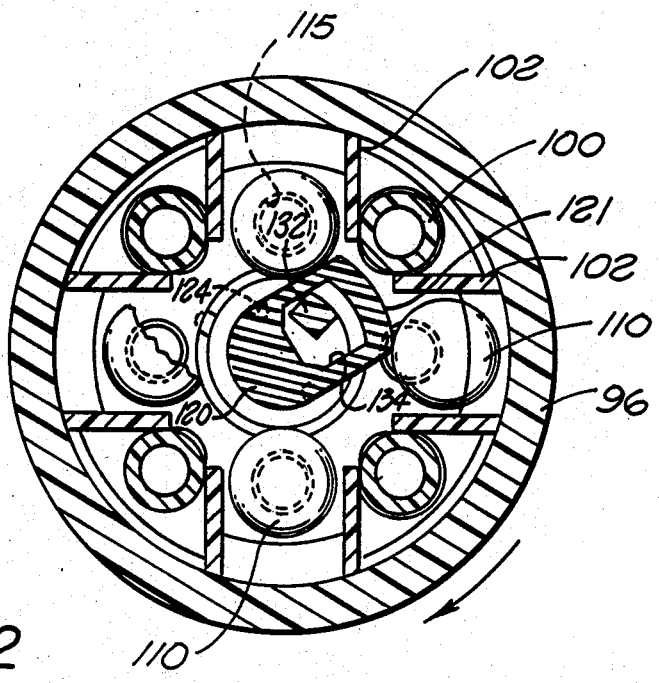
FIG. 22 is an enlarged horizontal sectional view similar to FIG. 12 but illustrating cam operation for use in rapidly opening and closing nozzle passages to water flow.

More particularly, as shown in FIG. 22, initial contact of the nose end 121 of the cam 120 to unseat a valve ball 110 is resisted by the water pressure within the flow chamber 104 tending to keep the valve ball in the seated closed position. This initial resistance causes a partial winding up of the torsion arms 124, or, stated alternately, a limited rotation of the cam 120 about the axis of the cam rod 122, results in an increased unseating force applied to the engaged valve ball. A stiff limit post 132 projects upwardly from an axially offset position on the main cam rod into a clearance opening 134 in the cam block and is eventually engaged by a side wall of the cam block, as viewed in FIG. 22, when the limited rotation of the cam reaches a maximum setting, such as about thirty degrees. When this occurs, further spray head rotation displaces the engaged valve ball against the now-stiff cam 120 resulting in unseating of the valve from the underlying valve port. As soon as the valve ball partially opens the port, the pressure-loading force is reduced to permit the now comparatively high cam opening force to rapidly and substantially immediately move the valve ball to fully open the valve port. At the same time, the valve ball engaged by the trailing edge of the cam 120 is substantially immediately released for pressure-loaded return to the closed position. Conveniently, the positioning of the resultant spray pattern can be selected relative to surrounding terrain by installing the housing 16 with an external location rib 17 (FIG. 3) at the beginning of the spray path.

In accordance with further aspects of the invention, the cam rod 122 is formed integrally with the cam block and conveniently includes bypass means for insuring constant, predictable sprinkler rotary operation by maintaining a constant pressure differential across the swirl ports 42 (FIG. 3) regardless of the water flow rate through the sprinkler. More specifically, the hollowed lower end 127 of the cam rod 120 includes one or more bypass ports 136 of predetermined size in relation to the total open flow area provided by the nozzle passage or passages 98 open in the spray head 14 at any given point in time. These bypass ports 136 thus function to subject the water turbine 38 to driving interaction with a limited portion of the water flowing through the sprinkler, with the remaining water bypassing the turbine 38.

Figure 23:
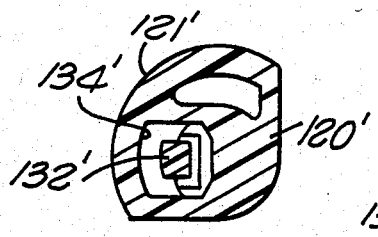
FIG. 23 is an enlarged horizontal sectional view similar to FIG. 20 but illustrating construction details of an alternative cam adapted to provide a half-circle irrigation spray path.
Figure 24:
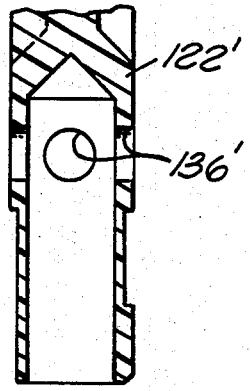
FIG. 24 is an enlarged fragmented vertical sectional view similar to FIG. 21 but depicting an alternative cam rod geometry for use with the half-circle cam of FIG. 23.

The quarter-circle cam 120 and its associated cam rod 122 can be removed quickly and easily from the top of the sprinkler and replaced as desired with an alternative cam 120' and associated cam rod 122', as viewed in FIGS. 23 and 24, designed to provide a half-circle spray pattern of water distribution. Other cam and cam rod configurations may be provided for still other spray pattern widths, for example, such as the three-quarter-circle cam 120'' and associated cam rod 122'', as viewed in FIGS. 25 and 26.

More particularly, with reference to the half-circle cam 120' and associated cam rod 122' shown in FIGS. 23 and 24, the cam block at the top of the cam rod is similar in construction to the previously described quarter-circle cam except that the cam block has an increased width and overall contoured shape to displace and retain two of the valve balls 110 in an open position at the same time. As a result, two of the nozzle passages 98 are open to water flow for outward projection of water streams from the sprinkler through the limits of a substantially half-circle spray pattern. The cam 122' includes the torsion arms (not shown) as described with respect to the quarter-circle cam 120 together with a limit post 132' projecting into a clearance opening 134' for rapid movement of the valve balls to and from the open and closed positions. One or more bypass ports 136' are formed in the lower end of the cam rod 122' (FIG. 24), wherein these bypass ports 136' are larger than the associated ports for the quarter-circle cam to accommodate the total flow area provided a pair of the nozzle passages 98 being open at all times. As a result, the water turbine 38 is subjected to the same driving action regardless of use of a quarter-circle or half-circle cam.

Figure 25:
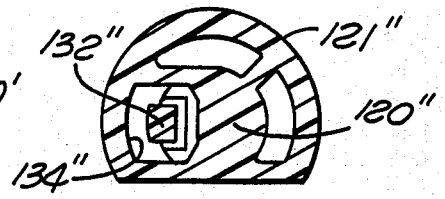
FIG. 25 is an enlarged horizontal sectional view similar to FIG. 20 but illustrating another cam adapted to provide a three-quarter-circle spray path.
Figure 21:
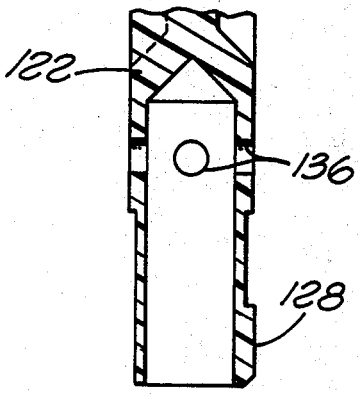
FIG. 21 is an enlarged fragmented vertical sectional view illustrating a lower or base end of the cam rod for use with the quarter-circle cam of FIG. 20.
Figure 26:
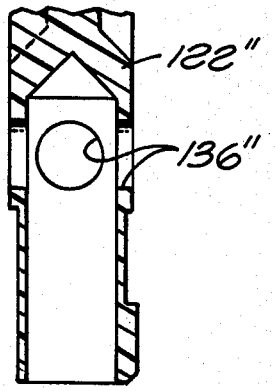
FIG. 26 is an enlarged vertical sectional view similar to FIG. 21 but depicting still another cam rod geometry for use with the three-quarter-circle cam of FIG. 25.

The three-quarter-circle cam 120'' shown in FIG. 25 is also similar to the previously described cams but has a greater cam width to retain three of the valve balls 110 in an open position. Accordingly, three of the nozzle passages 98 are also open to provide three outwardly projected streams which are rotated through a three-quarter-circle pattern. The cam 120'' is spring-loaded by the torsion arms (not shown) and includes a limit post 132'' within a clearance opening 134'' to insure rapid opening and closing of the valve ports. The associated cam rod 122'' has a lower end (FIG. 26) with further enlarged bypass ports 136'' to again provide constant speed driving of the turbine and resultant constant speed rotation of the water streams 12.

The individual cams 120, 120', and 120'' and the associated cam rods can be installed quickly and easily into the sprinkler by access to the upper end of the sprinkler spray head 14. More particularly, as shown in FIGS. 3 and 15–18, removal of the spray head cap 106 exposes the underlying flow chamber 104 and the cam positioned therein. The cam can then be lifted vertically from the flow chamber 104 to correspondingly extract the integral cam rod from within the pop-up stem and the lower end mounted within the central bore 44 of the drive case 40. A replacement cam and cam rod of selected geometry can then be installed quickly and easily by inserting the cam rod lower end through the spray head 14 and the drive sleeve. The X-shaped guide base 126 of the cam rod insures substantially centered insertion until the lower end 127 reaches the upper end of the hub bore 44 (FIGS. 3 and 16). Within the upper end of the bore 44, the axially lower end of the cam rod seats against a helical ramp 137 which self-guides the cam rod for aligning the key 128 to fit into the associated slot or keyway. A seal ring 138 conveniently is seated between the ramp 137 and a downwardly presented shoulder 140 on the cam rod to limit bypass flow to the associated bypass ports 136. When the lower end 127 of the cam rod is seated, as described, the cam 120 at the upper end of the cam rod is properly positioned within the flow chamber 104 whereupon the spray head cap 106 can be replaced and sprinkler operation can be resumed.

Figure 27:
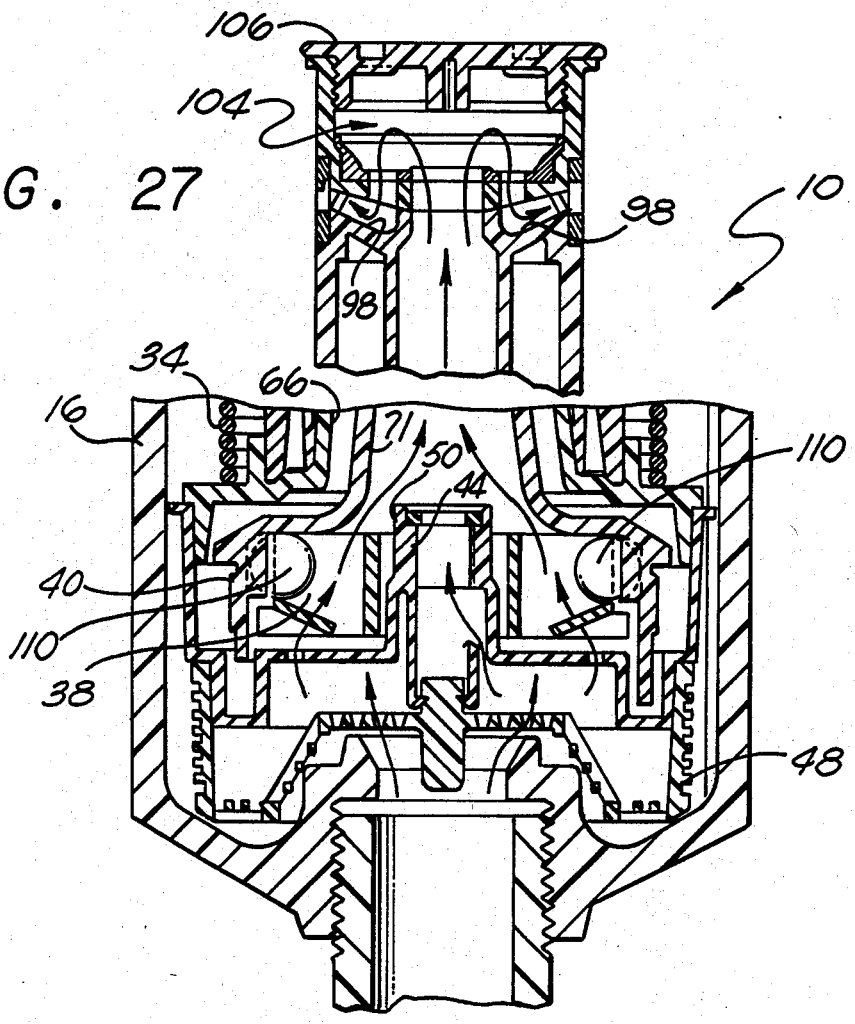
FIG. 27 is a fragmented vertical sectional view similar to FIG. 5, but illustrating omission of the cam and cam rod from the sprinkler to provide a full-circle spray path during sprinkler operation.
Figure 20:
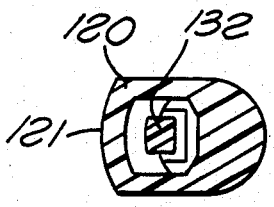
FIG. 20 is an enlarged horizontal sectional view illustrating construction details of a preferred cam adapted to provide a quarter-circle spray path upon sprinkler rotation.

In the event sprinkler operation is desired with a full-circle spray pattern, the cam and cam rod can be removed entirely from the sprinkler in the manner described with respect to changing of the cams. In addition, the valve balls 110 are removed when full-circle operation is desired, thereby opening all four nozzle passages 98 at all times, as viewed in FIG. 27. Accordingly, since none of the nozzle passages are closed, four water streams 12 are projected outwardly from the sprinkler and are rotated continuously in small rotational steps through a full-circle spray pattern. Importantly, for full-circle operation, the central bore 44 in the drive case 40 defines the bypass port of appropriate size such that the streams are rotated at substantially the same rotational speed as a sprinkler including one of the cams and thus adapted for part-circle operation.

Accordingly, the present invention provides a rotating stream sprinkler which can be constructed economically from predominantly plastic components and is adapted quickly and easily for selected part-circle or full-circle spray pattern operation. In the preferred pop-up sprinkler embodiment, supply of water under pressure to the sprinkler displaces the pop-up assembly 30 together with the spray head 14 and the drive assembly 32 from the retracted position (FIGS. 1 and 3) to the elevated spraying position (FIGS. 2 and 5). When the elevated spraying position is reached, a portion of the water flowing in driving engagement with the turbine 38 causes the turbine to rotate at sufficient speed to displace the drive balls 64 into repeating and regular impact engagement with the anvils 76 at the lower end of the drive sleeve 71. Such drive ball/anvil interaction rotates the drive sleeve and the spray head 14 including the nozzle passages 98. For part-circle operation, the selected cam such as the quarter-circle cam 120 displaces one or more of the valve balls 110 within the spray head to permit outwardly projecting water streams within the limits of the prescribed spray path. Importantly, the construction of the drive assembly 32 and the spray head 14 insures a flushing action water flow to prevent grit accumulation which could otherwise interfere with proper sprinkler operation.

Figure 28:
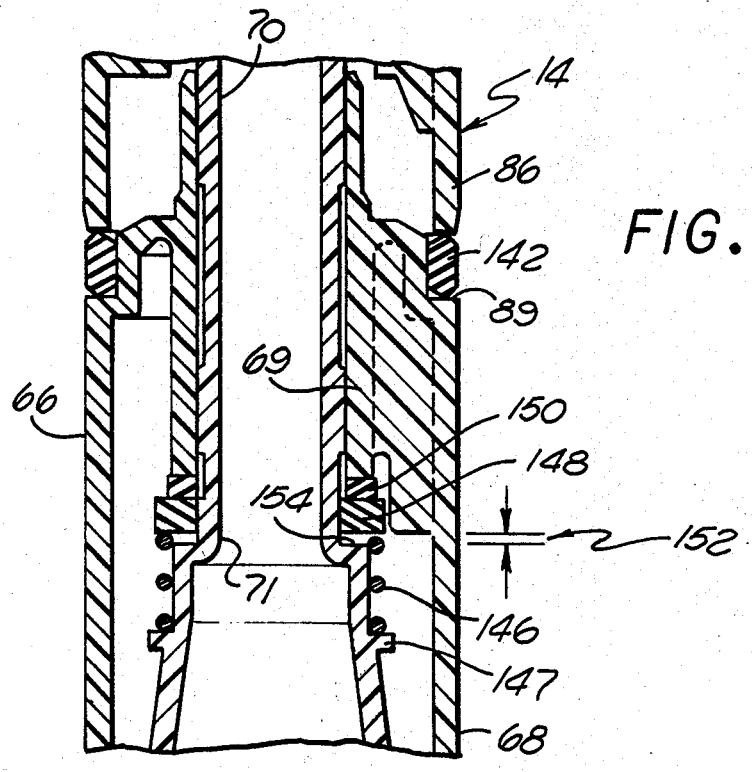
FIG. 28 is an enlarged fragmented vertical sectional view of a portion of the sprinkler and depicting operation of bearing seal means during pop-up or pop-down movement of the spray head.
Figure 29:
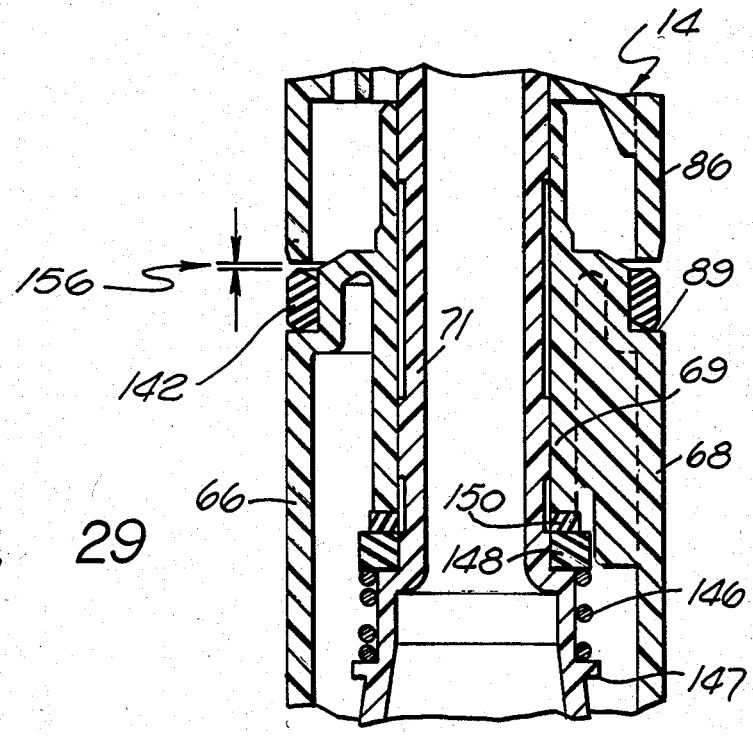
FIG. 29 is an enlarged fragmented vertical sectional view similar to FIG. 28 but depicting the orientation of the bearing seal means during normal spraying operation of the sprinkler.

In accordance with further aspects of the invention, the sprinkler is rendered further resistant to the effects of grit and other abrasive particles by providing an improved bearing seal means acting between the bearing sleeve 66 and the spray head 14, as viewed in FIGS. 28 and 29. In addition, this improved bearing seal means is designed to prevent entry of grit or the like between the relatively moving surfaces of the center guide 69 of the bearing sleeve 66 and the rotatable drive sleeve, especially during pop-up or pop-down motion as the parts transition past the wiper seal member 28 lining the central opening 26 in the housing cap 24 (FIG. 3).

More particularly, as shown in FIG. 28, the improved bearing seal means comprises a resilient ring 142 of annular shape positioned generally coaxially between the axially lower end of the skirt 86 on the spray head base 80 and an upwardly presented shoulder 89 on the guide cylinder 68 of the bearing sleeve 66. Within the guide cylinder 68, a small thrust spring 146 reacts between an outwardly radiating flange 147 on the drive sleeve 71 and a resilient washer 148 which provides an inner diameter seal with the exterior of the drive sleeve. This seal washer 148 is biased by the thrust spring 146 against a second washer 150 of Teflon or the like which seats against the axially lower end of the center guide 69. Accordingly, the two washers 148 and 150 cooperatively provide sealing between the nonrotating bearing sleeve 66 and the rotatable drive sleeve 71, with the thrust spring maintaining this sealing relation at all times to prevent grit intrusion between the components.

When water under pressure within the sprinkler housing is relatively low, such as when the pressure is increasing or decreasing during pop-up or pop-down movement, respectively, the thrust spring 146 shifts the drive sleeve downwardly within the center guide 69 sufficiently to shift the skirt 86 of the spray head into seated relation with the outer seal ring 142 (FIG. 28). A small gap 152 is thus created between the washer 148 and another shoulder 154 on the drive sleeve. In this configuration, entry of grit or other particles into the sprinkler past the seal ring 142 is prevented. However, when the drive sleeve is in the elevated spraying position with pressure within the housing at a normal operating pressure, the water pressure acting upwardly upon the drive sleeve shifts said drive sleeve upwardly within the center guide 69, and against the force applied by the thrust spring 146, as viewed in FIG. 29. This shifting motion eliminates the gap between the inner washer 148 and the drive sleeve shoulder 154 and instead creates a small gap 156 of similar dimension between the seal ring 142 and the spray head skirt 86 to permit free spray head and stem rotation with reduced friction relative to the bearing sleeve 66.

A variety of further modifications and improvements to the present invention will be apparent to those skilled in the art. Accordingly, no limitation upon the invention is intended by way of the description and the accompanying drawings, except as set forth in the appended claims.

What is claimed is:

1. A rotary drive sprinkler, comprising:

a sprinkler housing adapted for connection to supply of irrigation water;

a spray head having at least one nozzle passage formed therein for outward projection of an irrigation water stream, said spray head being supported for rotation relative to said housing;

rotary drive means for rotatably driving said spray head through successive full-circle rotations;

a valve member comprising a valve ball movable with at least some rolling motion between an open position permitting water flow from said housing to said spray head nozzle passage for outward projection of the water stream from said spray head, and a closed position preventing water flow to prevent outward projection of the water stream from said spray head; and control means for moving said valve member from said closed position to said open position for a predetermined part-circle portion of each full-circle rotation of said spray head.

2. The rotary drive sprinkler of claim 1 including means guiding said valve member for normal pressure-loaded movement to said closed position when water is supplied to said sprinkler housing.

3. The rotary drive sprinkler of claim 1 wherein said valve member is disposed generally at the upstream end of said spray head nozzle passage.

4. The rotary drive sprinkler of claim 1 including a plurality of nozzle passages formed in said spray head, and a plurality of valve balls each associated with a respective one of said nozzle passages and movable between said open and closed positions for respectively permitting and preventing water flow to the associated nozzle passage, and said control means including means for moving said valve balls to said open positions when said nozzle passages associated therewith are rotated through said predetermined part-circle portion of each full-circle rotation of said spray head such that irrigation water projected outwardly through said nozzle passages is distributed over surrounding terrain within the limits of a predetermined arcuate path corresponding with said predetermined part-circle portion.

5. The rotary drive sprinkler of claim 1 wherein said control means comprises a selection of cams of different predetermined widths for respectively maintaining said valve member in said open position through a different predetermined part-circle portion of each full-circle rotation of said spray head, said cams being removably mounted one at a time within said sprinkler.

6. The rotary drive sprinkler of claim 1 wherein said nozzle passage including means defining a resilient valve seat generally at the upstream end of said nozzle passage, said valve seat being disposed for engagement by said valve member when said valve member is in said closed position.

7. The rotary drive sprinkler of claim 1 wherein said spray head includes a flow chamber for receiving water flow from said sprinkler housing, said nozzle passage having an upstream end communicating with said flow chamber and an outwardly presented discharge end, said valve member and said control means being disposed within said flow chamber, and said valve member being normally pressure-loaded to said closed position by water flow into said flow chamber.

8. The rotary drive sprinkler of claim 7 wherein said nozzle passage extends generally downwardly from said flow chamber and then turns generally radially outwardly to said discharge end.

9. A rotary drive sprinkler, comprising:

a sprinkler housing adapted for connection to supply of irrigation water;

a spray head having at least one nozzle passage formed therein for outward projection of an irrigation water stream, said spray head being supported for rotation relative to said housing;

rotary drive means for rotatably driving said spray head through successive full-circle rotations;

a valve member movable between an open position permitting water flow from said housing to said spray head nozzle passage for outward projection of the water stream from said spray head, and a closed position preventing water flow to prevent outward projection of the water stream from said spray head; and means for guiding said valve member for normal pressure-loaded movement to said closed position when water is supplied to said sprinkler housing;

control means for moving said valve member from said closed position to said open position for a predetermined part-circle portion of each full-circle rotation of said spray head; and spring means for resiliently supporting said control means such that said spring means is deflected upon initial contact of said control means with said valve member, when said valve member is pressure-loaded to said closed position, to apply an increasing opening force to said valve member for displacing said valve member rapidly from said closed position to said open position.

10. The rotary drive sprinkler of claim 9 further including limit means for positively displacing said control means against said valve member when said spring means is deflected to apply a predetermined opening force to said valve member.

11. The rotary drive sprinkler of claim 1 wherein said rotary drive means includes a water-driven turbine within said housing.

12. The rotary drive sprinkler of claim 11 wherein said turbine includes at least two symmetrically arranged and radially outwardly open ball tracks each having a ramped floor inclined in a radially outward direction, a corresponding number of drive balls carried respectively within said ball tracks, said drive balls being displaced radially outwardly and upwardly along said ramped floors upon turbine rotation at or above a threshold speed, and a drive ring coupled to said spray head and including a ball race interrupted by a plurality of anvils arranged for substantially simultaneous impact by said drive balls to rotate said drive ring and said spray head through a small rotational step.

13. The rotary drive sprinkler of claim 11 further including bypass means formed integrally with said control means for bypassing a portion of the water flow through said housing away from driving interaction with said turbine.

14. The rotary drive sprinkler of claim 12 wherein at least one of said turbine, said anvils, said drive balls, and said ball race is formed from a resilient material.

15. The rotary drive sprinkler of claim 14 wherein said resilient material has a hardness of less than about 100R Rockwell hardness.

16. The rotary drive sprinkler of claim 11 wherein said rotary drive means includes drive case means for rotatably confining said turbine with substantial flow clearances around and about all surfaces of said turbine to permit water flow around and about said turbine surfaces to flush grit therefrom.

17. The rotary drive sprinkler of claim 1 further including a pop-up assembly movable between a retracted position concealed substantially within said sprinkler housing, and an elevated spraying position with the upper end of said assembly disposed above said housing, said spray head being mounted at said upper end of said assembly.

18. A rotary drive sprinkler, comprising:

a sprinkler housing adapted for connection to a supply of water under pressure;

a spray head having at least one nozzle passage formed therein for outward projection of a water stream;

means for rotatably supporting said spray head for rotation through a full-circle rotation relative to said sprinkler housing;

means for rotatably driving said spray head through successive full-circle rotations relative to said sprinkler housing;

means forming a flow chamber for receiving water from the sprinkler housing and defining a valve seat generally at the upstream end of said nozzle passage;

a valve member generally unconstrained within said flow chamber and normally pressure-loaded upon supply of water to said sprinkler housing for movement to a closed position upon said valve seat to prevent water flow from said housing into and through said nozzle passage; and control means for moving said valve member to an open position relative to said valve seat for a predetermined part-circle portion of each full-circle rotation of said spray head to permit water flow into said nozzle passage and outward projection therefrom within the limits of a prescribed arcuate spray path.

19. The rotary drive sprinkler of claim 18 wherein said valve member comprises a ball.

20. The rotary drive sprinkler of claim 18 including a plurality of nozzle passages formed in said spray head, and a plurality of valve members each associated with a respective one of said nozzle passages and movable between said open and closed positions for respectively permitting and preventing water flow to the associated nozzle passage, and said control means including means for moving said valve members to said open positions when said nozzle passages associated therewith are rotated through said predetermined part-circle portion of each full-circle rotation of said spray head such that irrigation water projected outwardly through said nozzle passages is distributed over surrounding terrain within the limits of a predetermined arcuate path corresponding with said predetermined part-circle portion.

21. The rotary drive sprinkler of claim 18 wherein said spray head includes a flow chamber for receiving water flow from said sprinkler housing, said nozzle passage having an upstream end communicating with said flow chamber and an outwardly presented discharge end, said valve member and said control means being disposed within said flow chamber, and said valve member being normally pressure-loaded to said closed position by water flow into said flow chamber.

22. The rotary drive sprinkler of claim 21 wherein said nozzle passage extends generally downwardly from said flow chamber and then turns generally radially outwardly to said discharge end.

23. The rotary drive sprinkler of claim 18 including spring means for resiliently supporting said control means such that said spring means is deflected upon initial contact of said control means with said valve member, when said valve member is pressure-loaded to said closed position, to apply an increasing opening force to said valve member for displacing said valve member rapidly from said closed position to said open position.

24. The rotary drive sprinkler of claim 23 further including limit means for positively displacing said control means against said valve member when said spring means is deflected to apply a predetermined opening force to said valve member.

25. The rotary drive sprinkler of claim 18 wherein said rotary drive means includes a water-driven turbine within said housing.

26. The rotary drive sprinkler of claim 18 further including a pop-up assembly movable between a retracted position concealed substantially within said sprinkler housing, and an elevated spraying position with the upper end of said pop-up assembly disposed above said housing, said spray head being mounted at said upper end of said pop-up assembly.

27. A rotary drive sprinkler, comprising:

a sprinkler housing adapted for connection to supply of water under pressure;

a spray head having a plurality of generally symmetrically arranged and outwardly open nozzle passages formed therein each for outward projection of a water stream;

means for rotatably supporting said spray head for rotation through a full-circle rotation relative to said sprinkler housing;

means for rotatably driving said spray head through successive full-circle rotations relative to said sprinkler housing;

a plurality of valve members comprising a plurality of valve balls each associated with a respective one of said nozzle passages and movable with at least some rolling motion between an open and closed position for respectively permitting and preventing water flow to said associated nozzle passage; and control means for engaging each of said valve members and for moving said valve members to the open position when the nozzle passage associated therewith is oriented for outward projection of water within the limits of a predetermined arcuate spray path.

28. The rotary drive sprinkler of claim 27 including means guiding each of said valve members for normal pressure-loaded movement to said closed position when water is supplied to said sprinkler housing.

29. The rotary drive sprinkler of claim 27 further including valve seat means generally at the upstream ends of said nozzle passages, said valve members being engageable with said valve seat means when in said closed positions.

30. The rotary drive sprinkler of claim 27 wherein said spray head includes a flow chamber for receiving water from said sprinkler housing, each of said nozzle passages having an upstream end communicating with said flow chamber and an outwardly presented discharge end, said valve members and said control means being disposed within said flow chamber and said valve members being normally pressure-loaded to said closed positions.

31. The rotary drive sprinkler of claim 30 wherein each of said nozzle passages extends generally downwardly from said flow chamber and then turns generally radially outwardly to said discharge end.

32. A rotary drive sprinkler, comprising:

a sprinkler housing adapted for connection to a supply of water under pressure;

a spray head having a plurality of generally symmetrically arranged and outwardly open nozzle passages formed therein each for outward projection of a water stream;

means for rotatably supporting said spray head for rotation through a full-circle rotation relative to said sprinkler housing;

means for rotatably driving said spray head for rotation through successive full-circle rotations relative to said sprinkler housing;

a plurality of valve members each associated with a respective one of said nozzle passages and movable between an open and closed position for respectively permitting and preventing water flow to said associated nozzle passage;

means for guiding each of said valve members for normal pressure-loaded movement to said closed position when water is supplied to said sprinkler housing;

control means for engaging each of said valve members and for moving said valve members to the open position when the nozzle passage associated therewith is oriented for outward projection of water within the limits of a predetermined arcuate spray path; and spring means for resiliently supporting said control means such that said spring means is deflected upon contact with each of said valve members, when said valve member is in said closed position, to apply an increasing opening force to the contacted valve member for displacing said valve member rapidly to said open position.

33. The rotary drive sprinkler of claim 32 further including limit means for positively displacing said control means against said valve members when said spring means is deflected to apply a predetermined opening force to said valve members.

34. The rotary drive sprinkler of claim 32 wherein said control means includes a trailing edge adapted to release one of said valve members for rapid pressure-loaded return to said closed position substantially simultaneously with said displacing of the contacted valve member to said open position.

35. A rotary drive sprinkler, comprising:

a sprinkler housing adapted for connection to a supply of water under pressure;

a spray head having a flow chamber formed therein, and a plurality of generally symmetrically arranged nozzle passages leading from said flow chamber to generally outwardly directed discharge ends of said nozzle passages;

a plurality of valve members within said flow chamber, each of said valve members being associated with a respective one of said nozzle passages and movable between an open position and a closed position for respectively permitting and preventing water flow from said flow chamber into said nozzle passages;

means for rotating said spray head with said valve members relative to said sprinkler housing; and cam means within said flow chamber and constrained against rotation with said spray head, said cam means including means for moving said valve members from said closed positions to said open positions when the nozzle passages associated therewith are oriented to distribute water flowing therethrough within the limits of a prescribed arcuate path, said valve members being pressure-loaded upon supply of water under pressure into said housing to urge said valve members in a first direction to said closed positions to prevent water flow through said nozzle passages when said passages are oriented to distribute water flowing therethrough outside said prescribed arcuate path, and said means for moving said valve members displacing said valve members in a second direction generally perpendicular to said first direction to move said valve members to said open positions.

36. The rotary drive sprinkler of claim 35 wherein each of said valve members comprises a ball separated from said cam means.

37. The rotary drive sprinkler of claim 35 wherein said flow chamber is disposed above said nozzle passages, said nozzle passages extending generally downwardly from said flow chamber and then turning generally radially outwardly.

38. The rotary drive sprinkler of claim 37 wherein said spray head comprises upper and lower interfitting nozzle portions having mating faces cooperatively defining said nozzle passages.

39. The rotary drive sprinkler of claim 37 wherein said spray head further includes a removable spray head cap to permit access to said flow chamber, said cam means being removably installed within said flow chamber.

40. The rotary drive sprinkler of claim 36 wherein said spray head further defines a plurality of ball tracks respectively receiving said balls.

41. The rotary drive sprinkler of claim 36 further including a valve seat ring disposed within said flow chamber and including means defining a plurality of valve seats disposed respectively at the upstream ends of said nozzle passages, said balls being engageable with said valve seats in said closed positions.

42. The rotary drive sprinkler of claim 41 wherein said seat ring is formed from a resilient material.

43. The rotary drive sprinkler of claim 35 further including adjustable radius reducer means at the discharge ends of at least some of said nozzle passages.

44. The rotary drive sprinkler of claim 35 further including a pop-up assembly movable between a retracted position substantially concealed within said housing and an elevated spraying position with an upper end thereof projecting above the housing, and further including means for locking said spray head onto the upper end of said pop-up assembly.

45. The rotary drive sprinkler of claim 35 wherein said valve members and said cam means are removable from said spray head to permit water to flow through said nozzle passages for distribution through a full-circle spray path.

46. The rotary drive sprinkler of claim 35 further including spring means for resiliently supporting said cam means such that said spring means is deflected upon contact with each of said valve members, when said valve member is in said closed position, to apply an increasing opening force to the contacted valve member for displacing said valve member rapidly to said open position.

47. The rotary drive sprinkler of claim 46 wherein said cam means comprises a cam block having a portion thereof engageable with said valve members, said spring means comprising torsion means supporting said cam block with a predetermined resistance to rotation upon contact of said cam block with one of said valve members.

48. The rotary drive sprinkler of claim 47 wherein said torsion means is formed integrally with said cam block.

49. The rotary drive sprinkler of claim 47 further including a relatively rigid limit post for preventing cam block rotation beyond a preset limit.

50. The rotary drive sprinkler of claim 49 wherein said limit post extends with normal clearance into an aperture formed in said cam block.

51. The rotary drive sprinkler of claim 50 wherein said limit post is formed integrally with said cam block.

52. The rotary drive sprinkler of claim 35 wherein said rotating means comprises a water driven turbine, means for directing a portion of the water flow into said housing into driving relation with said turbine, and means for bypassing another portion of the water flow into said housing away from driving relation with said turbine, and further wherein said cam means comprises a cam within said flow chamber, a cam rod extending from said cam and having at least one bypass port formed therein to define the open flow area provided by said bypass means.

53. The rotary drive sprinkler of claim 52 wherein said cam rod includes an open-ended lower end having said at least one bypass port formed therein, said rotating means comprising a case with a central bore therein for receiving said cam rod lower end when said cam in disposed within said flow chamber, and means for preventing rotation of said cam rod lower end relative to said case.

54. The rotary drive sprinkler of claim 53 further including at least one alternate cam and cam rod, said alternate cam having a shape adapted to move said valve members to said open positions for distributing water within the limits of a different arcuate spray path, and said alternate cam rod having at least one bypass port of different size therein.

55. The rotary drive sprinkler of claim 53 wherein said cam and cam rod are integrally formed.

56. The rotary drive sprinkler of claim 53 further including an axially offset pair of torsion bars connected between said cam and said cam rod.

57. The rotary drive sprinkler of claim 53 wherein said cam, torsion bars and cam rod are integrally formed.

58. The rotary drive sprinkler of claim 54 further including means for self-guided reception of said cam rod lower end into said case bore.

59. A rotary drive sprinkler, comprising:

a sprinkler housing adapted for connection to a supply of water under pressure;

a spray head including means for projecting water outwardly from the housing; and means for rotatably driving said spray head to distribute the outwardly projected water over surrounding terrain, said drive means including a turbine drive chamber, a rotatable turbine within said chamber and having a plurality of outwardly radiating vanes, guide means projecting radially outwardly beyond said vanes for confining said turbine in relatively loosely centered relation within said chamber and for free rotation with substantial flow clearance around and about all surfaces of the turbine, and means for guiding water flow into driving relation with said vanes, said water flow passing around and about said turbine to wash grit therefrom.

60. The rotary drive sprinkler of claim 59 wherein said turbine includes at least two symmetrically arranged and radially outwardly open ball tracks each having a ramped floor inclined in a radially outward direction, a corresponding number of drive balls carried respectively within said ball tracks, said drive balls being displaced radially outwardly and upwardly along said ramped floors upon turbine rotation at or above a threshold speed, and a drive ring coupled to said spray head and including an inner ball race interrupted by a plurality of radially inset anvils arranged for substantially simultaneous impact by said drive balls to rotate said drive ring and said spray head through a small rotational step.

61. The rotary drive sprinkler of claim 60 further including a bypass means for guiding a portion of the water flow in bypass relation to said turbine.

62. The rotary drive sprinkler of claim 60 wherein at least one of said turbine, said anvils, said drive balls and said ball race is formed from a resilient material.

63. The rotary drive sprinkler of claim 62 wherein said resilient material has a hardness of less than about 100R Rockwell hardness.

64. A rotary drive sprinkler, comprising:

a sprinkler housing adapted for connection to a supply of water under pressure;

a spray head including means for projecting water outwardly from the housing; and means for rotatably driving said spray head to distribute the outwardly projected water over surrounding terrain, said drive means including a rotatable turbine having a generally cylindrical inner cylinder with a plurality of outwardly radiating vanes, a drive case having said turbine rotatably supported therein with substantial flow clearances around and about all surfaces of the turbine, guide means projecting radially outwardly beyond said vanes for confining said turbine in relatively loosely centered relation within said drive case, and means for guiding water flow into said drive case in driving relation with said turbine vanes.

65. The rotary drive sprinkler of claim 64 wherein said turbine includes at least two symmetrically arranged and radially outwardly open ball tracks each having a ramped floor inclined in a radially outward direction, a corresponding number of drive balls carried respectively within said ball tracks, said drive balls being displaced radially outwardly and upwardly along said ramped floors upon turbine rotation at or above a threshold speed, and a drive ring coupled to said spray head and including an inner ball race interrupted by a plurality of radially inset anvils arranged for substantially simultaneous impact by said drive balls to rotate said drive ring and said spray head through a small rotational step.

66. The rotary drive sprinkler, comprising:

a sprinkler housing adapted for connection to a supply of water under pressure;

a pop-up assembly within said housing and including a drive sleeve movable between a retracted position concealed substantially within said housing and an elevated spraying position with the upper end thereof disposed above said housing;

a spray head at the upper end of said drive sleeve;

drive means within said housing and movable with said drive sleeve between said retracted and elevated positions, said drive means including a drive case supported against rotation within said housing and including a drive element for rotatably driving said drive sleeve, said drive case including an upper bearing sleeve having said drive sleeve rotatably supported therein; and bearing seal means including an annular seal ring interposed between axially facing surfaces of said bearing sleeve and said spray head, and spring means for biasing said axially facing surfaces into sealed contact with said seal ring when said drive sleeve is in said retracted position and when said drive sleeve is moving between said retracted and spraying positions, said spring means being overcome by fluid pressure within said housing when said drive sleeve is in said spraying position to permit separation of one of said axially facing surfaces for reduced frictional restriction of rotation of said spray head relative to said bearing sleeve.

67. The rotating drive sprinkler of claim 66 further including a first seal washer having an inner diameter surface in sealing engagement with the exterior of said drive sleeve, and a second seal washer having an axial thrust surface for sealing engagement with a shoulder on said bearing sleeve, and a thrust spring bearing against said first seal washer to urge said first seal washer axially against said second seal washer to maintain said axial thrust surface thereof in sealing relation with said bearing sleeve shoulder.

68. A rotary drive sprinkler, comprising:

a sprinkler housing adapted for connection to a supply of water under pressure;

a pop-up assembly within said housing and including a drive sleeve movable between a retracted position concealed substantially within said housing and an elevated spraying position with the upper end thereof disposed above said housing;

a spray head at the upper end of said drive sleeve;

drive means within said housing and movable with said drive sleeve between said retracted and elevated positions, said drive means including a drive case supported against rotation within said housing and including a drive element for rotatably driving said drive sleeve, said drive case including an upper bearing sleeve having said drive sleeve rotatably supported therein; and bearing seal means including a first seal washer having an inner diameter surface in sealing engagement with the exterior of said drive sleeve, and a second seal washer having an axial thrust surface for sealing engagement with a shoulder on said bearing sleeve, and a thrust spring bearing against said first seal washer to urge said first seal washer axially against said second seal washer to maintain said axial thrust surface thereof in sealing relation with said bearing sleeve shoulder.

69. A rotary drive sprinkler, comprising:

a sprinkler housing adapted for connection to a supply water under pressure;

a spray head including means for projecting water outwardly from the housing; and impact drive means for rotatably driving said spray head to distribute the outwardly projected water over surrounding terrain, said impact drive means including a drive member movably driven by water flowing into and through said sprinkler housing and a driven member coupled to said spray head, said drive member including impact means for impact engagement with said driven member to displace said driven member in a manner rotatably driving said spray head;

at least one of said drive member impact means and said driven member being formed from a resilient material having a hardness substantially less than about 100R Rockwell hardness.

70. The rotary drive sprinkler of claim 69 wherein said drive means includes a drive ball rotatably driven by water flowing into and through said sprinkler housing, said driven member including an anvil disposed for impact engagement by said drive ball, at least one of said drive ball and said anvil being formed from said resilient elastomer material.

71. A rotary drive sprinkler of claim 70 wherein said drive member further includes a turbine rotated by water flowing into and through said sprinkler housing, said turbine including a radially outwardly open ball track having said drive ball carried therein, at least one of said turbine, said drive ball, and said anvil being formed from said resilient material.

72. The rotary drive sprinkler of claim 71 including means for confining said turbine relatively loosely within said sprinkler housing for free rotation with substantial flow clearance around and about all surfaces of the turbine, and further including means for guiding water flow into driving relation with said turbine, said water flow passing around and about said turbine to wash grit therefrom.

73. A rotary drive sprinkler, comprising:

a sprinkler housing adapted for connection to a supply of irrigation water;

a spray head having a flow chamber for receiving water flow from said sprinkler housing, and at least one nozzle passage leading outwardly from said flow chamber for outward discharge of water from said spray head as an irrigation water stream, said spray head being supported for rotation relative to said sprinkler housing;

rotary drive means for rotatably driving said spray head through successive full circle rotations;

a valve ball within said flow chamber;

track means for guiding said valve ball for movement with at least some rolling motion between a closed position preventing outward water flow from said flow chamber through said nozzle passage, and an open position permitting outward water flow from said flow chamber through said nozzle passage, said valve ball being pressure-loaded toward said closed position upon supply of water to said sprinkler housing; and means responsive to the rotational position of said spray head relative to said sprinkler housing for displacing and holding said valve ball in said open position for a predetermined part-circle portion of each full-circle rotation of said spray head.

74. The rotary drive sprinkler of claim 73 wherein said means responsive to the rotational position of said spray head comprises a cam for contacting said valve ball to displace said valve ball toward said open position in a direction initially generally perpendicular to pressure-loading forces urging said valve ball toward said closed position.

75. The rotary drive sprinkler of claim 73 wherein said nozzle passage is generally vertically oriented, said track means including a ramp angling outwardly and upwardly from said nozzle passage, said means responsive to the rotational position of said spray head displacing said valve ball toward said open position along said ramp.

76. The rotary drive sprinkler of claim 73 including a plurality of said nozzle passages and a plurality of said valve balls, said track means including a plurality of tracks for guiding said valve balls loosely with at least some rolling motion respectively between said open and closed positions relative to said nozzle passages.

77. A rotary drive sprinkler, comprising:

a sprinkler housing adapted for connection to a supply of water under pressure;

a drive sleeve within said housing;

a spray head at the upper end of said drive sleeve;

drive means within said housing and including a drive case supported against rotation within said housing and a drive element for rotatably driving said drive sleeve, said drive case including a bearing sleeve having said drive sleeve rotatably supported therein; and bearing seal means including a first seal washer having an inner diameter surface in sealing engagement with the exterior of said drive sleeve, and a second seal washer having an axial thrust surface for sealing engagement with a shoulder on said bearing sleeve, and a thrust spring bearing against said first seal washer to urge said first seal washer axially against said second seal washer to maintain said axial thrust surface thereof in sealing relation with said bearing sleeve shoulder.

* * * * *